US008469538B2

(12) United States Patent
Leung

(10) Patent No.: US 8,469,538 B2
(45) Date of Patent: Jun. 25, 2013

(54) INFLATABLE DECORATIVE STRUCTURE WITH A LIGHT SYSTEM AND A DIFFUSING MEMBER

(75) Inventor: Chi Yin Alan Leung, Hong Kong (CN)

(73) Assignee: Polygroup Macau Limited (BVI), Tortola (VG)

( * ) Notice: Subject to any disclaimer, the term of this patent is extended or adjusted under 35 U.S.C. 154(b) by 181 days.

(21) Appl. No.: 13/011,437

(22) Filed: Jan. 21, 2011

(65) Prior Publication Data

US 2012/0020076 A1 Jan. 26, 2012

Related U.S. Application Data

(60) Provisional application No. 61/296,945, filed on Jan. 21, 2010.

(51) Int. Cl.
*F21V 33/00* (2006.01)

(52) U.S. Cl.
USPC ..... 362/155; 362/249.16; 362/311.13; 362/352; 362/355; 362/363

(58) Field of Classification Search
USPC ..... 362/154, 155, 249.13, 249.14, 249.16–249.19, 311.01, 311.02, 311.13, 318, 362/351, 352, 355, 363
See application file for complete search history.

(56) References Cited

U.S. PATENT DOCUMENTS

| | | | | |
|---|---|---|---|---|
| 1,465,333 | A * | 8/1923 | Ashley | 362/255 |
| 1,912,960 | A * | 6/1933 | Aki et al. | 446/224 |
| 2,748,256 | A * | 5/1956 | Moran | 362/362 |
| 2,871,343 | A * | 1/1959 | Whitney | 362/363 |
| 2,936,366 | A * | 5/1960 | Rainford | 362/363 |
| 5,117,344 | A * | 5/1992 | Perez | 362/352 |
| 5,183,329 | A * | 2/1993 | Chen | 362/352 |
| 5,609,411 | A * | 3/1997 | Wang | 362/234 |
| 6,012,826 | A * | 1/2000 | Chabert | 362/363 |
| 6,626,559 | B1 * | 9/2003 | Lin | 362/249.01 |
| 7,287,875 | B2 * | 10/2007 | Seika et al. | 362/249.16 |
| 7,413,494 | B2 * | 8/2008 | Huang | 446/220 |

FOREIGN PATENT DOCUMENTS

EP 295089 A2 * 12/1988

* cited by examiner

*Primary Examiner* — Ismael Negron
(74) *Attorney, Agent, or Firm* — Benjamin C. Wiles, Esq.; Ryan A. Schneider, Esq.; Troutman Sanders LLP

(57) ABSTRACT

The bladder assembly includes a bladder, which includes a seal or passage for dispensing and removing media to inflate the bladder. The bladder includes a housing for holding media and for storing and protecting the light system, and a diffusing mechanism for diffusing and distributing light emitted from the light system throughout the bladder. The diffusing mechanism can extend within the bladder, and the light system can illuminate light in and through the diffusing mechanism. The covering can cover the inflated bladder to provide additional shape and structure to the decorative system.

8 Claims, 7 Drawing Sheets

INFLATABLE DECORATIVE STRUCTURE WITH A LIGHT SYSTEM AND A DIFFUSING MEMBER

CROSS REFERENCE TO RELATED APPLICATION

This application claims benefit, under 35 U.S.C. §119(e), of U.S. Provisional Application Ser. No. 61/296,945, filed 21 Jan. 2010, the entire contents and substance of which are hereby incorporated by reference.

FIELD OF INVENTION

The presently disclosed subject matter relates to inflatable structures.

BACKGROUND

Ornamental and decorative devices are commonly used to decorate residential and commercial buildings in accordance with a desired theme. For instance, during holiday seasons, buildings may be decorated with temporary decorations depicting snowmen, polar bears, Santa Claus, reindeer, and the like. Alternatively, buildings may be decorated with temporary white or multi-colored lights to promote a festive holiday atmosphere. Temporary decorations may also be used during other selected times of the year to accommodate a desired temporary theme. Alternatively, permanent decorations may be used for themes other than holiday or temporary themes. For instance, businesses may use colored lights to draw attention to services or products, or sporting events may use various ball-shaped decorations (e.g., a baseball) to promote games.

SUMMARY

Briefly described, embodiments of the present invention relate to a decorative system. The decorative system can include an inflatable bladder assembly, a covering, a light diffusing mechanism and a light system. The inflatable bladder assembly can include a bladder that typically includes a seal and/or a passage for dispensing and removing media to inflate the bladder. The interior of the bladder can be adapted to receive and hold media inserted therein. When the bladder is inflated, it provides a desired, decorative shape. When the bladder is not inflated, it preferably provides a foldable profile that has a low weight and is easy to package and/or ship.

The covering can cover the inflated bladder to provide additional shape and structure to the decorative system. The covering can be a dressing for the bladder to provide added features and characteristics that the bladder itself does not depict. In some embodiments, the covering can be slipped over the bladder when it is partially inflated. In some embodiments, the covering can be stitched about the bladder.

The light system includes a plurality of light assemblies that can be illuminated. For example, the light assemblies can be a light emitting diode system that when power is supplied becomes illuminated and thus lights up the bladder. The light emitting diode system can have a plurality of light emitting diodes, which can be part of a single light unit. The diffusing mechanism can be configured to diffuse a portion of the light emanating from the light system into one or more parts of the system.

In some embodiments, the bladder includes a housing, for example a pouch or pocket, for storing and protecting the light system. In some embodiments, the bladder includes a diffusing mechanism for diffusing and distributing light emitted from the light system throughout the bladder. The diffusing mechanism can extend within the bladder, and the light system can illuminate light into the diffusing mechanism.

In one example, the presently disclosed subject matter is an inflatable decoration having a shape associated with a particular festive occasion. The decoration has an inflatable bladder assembly comprising an inflatable bladder having a first aperture for introducing media into the inflatable bladder. To provide illumination, the decoration has a light system and a second aperture disposed on the inflatable bladder assembly configured to receive at least a portion of the light system. The provide for certain lighting effects, the decoration has at least one diffusing member for diffusing light emanated from at least one light of the light system. Further, to provide additional decorative elements and/or to protect the decoration, the decoration has a covering to a least partially cover the inflatable bladder assembly.

In another exemplary and non-limiting example, a system is disclosed having an inflatable bladder assembly comprising an inflatable bladder having a first aperture for introducing media into the inflatable bladder. To provide illumination, the decoration has a light system and a second aperture disposed on the inflatable bladder assembly configured to receive at least a portion of the light system. Further, to provide additional decorative elements and/or to protect the decoration, the decoration has a covering to a least partially cover the inflatable bladder assembly.

In another exemplary and non-limiting example, the presently disclosed subject matter discloses an inflatable decorative system having an inflatable bladder assembly comprising an inflatable bladder having a first aperture for dispensing gaseous media into the bladder to inflate the bladder. The system also has a second aperture disposed on the bladder assembly configured to receive at least a portion of the light system and a covering. To provide illumination, the system has a light system comprising a light assembly with a light source, a base, and a bypass activating system extending downwardly from the base. The light system also has a socket assembly dimensioned to receive via insertion at least a portion of the base of the light assembly and a bypass mechanism positioned within the socket assembly comprising a conductive element having a pair of arms, wherein one or both of the arms of the conductive element are moveable between a first and second position. In some examples, the bypass activating system causes one or both of the arms to move to a first position to cause current flow through the light assembly upon insertion of the bypass activating system into the socket assembly. In some examples, upon removal of the bypass activating system from the socket assembly the current flow is bypassed around the light assembly and through the socket assembly.

The foregoing summarizes only a few aspects of the presently disclosed subject matter and is not intended to be reflective of the full scope of the presently disclosed subject matter as claimed. Additional features and advantages of the presently disclosed subject matter are set forth in the following description, may be apparent from the description, or may be learned by practicing the presently disclosed subject matter. Moreover, both the foregoing summary and following detailed description are exemplary and explanatory and are intended to provide further explanation of the presently disclosed subject matter as claimed.

BRIEF DESCRIPTION OF THE DRAWINGS

The accompanying drawings, which are incorporated in and constitute a part of this specification, illustrate multiple embodiments of the presently disclosed subject matter and, together with the description, serve to explain the principles of the presently disclosed subject matter; and, furthermore, are not intended in any manner to limit the scope of the presently disclosed subject matter.

In the drawings, the same reference numbers identify identical or substantially similar elements or acts.

Figure 1:
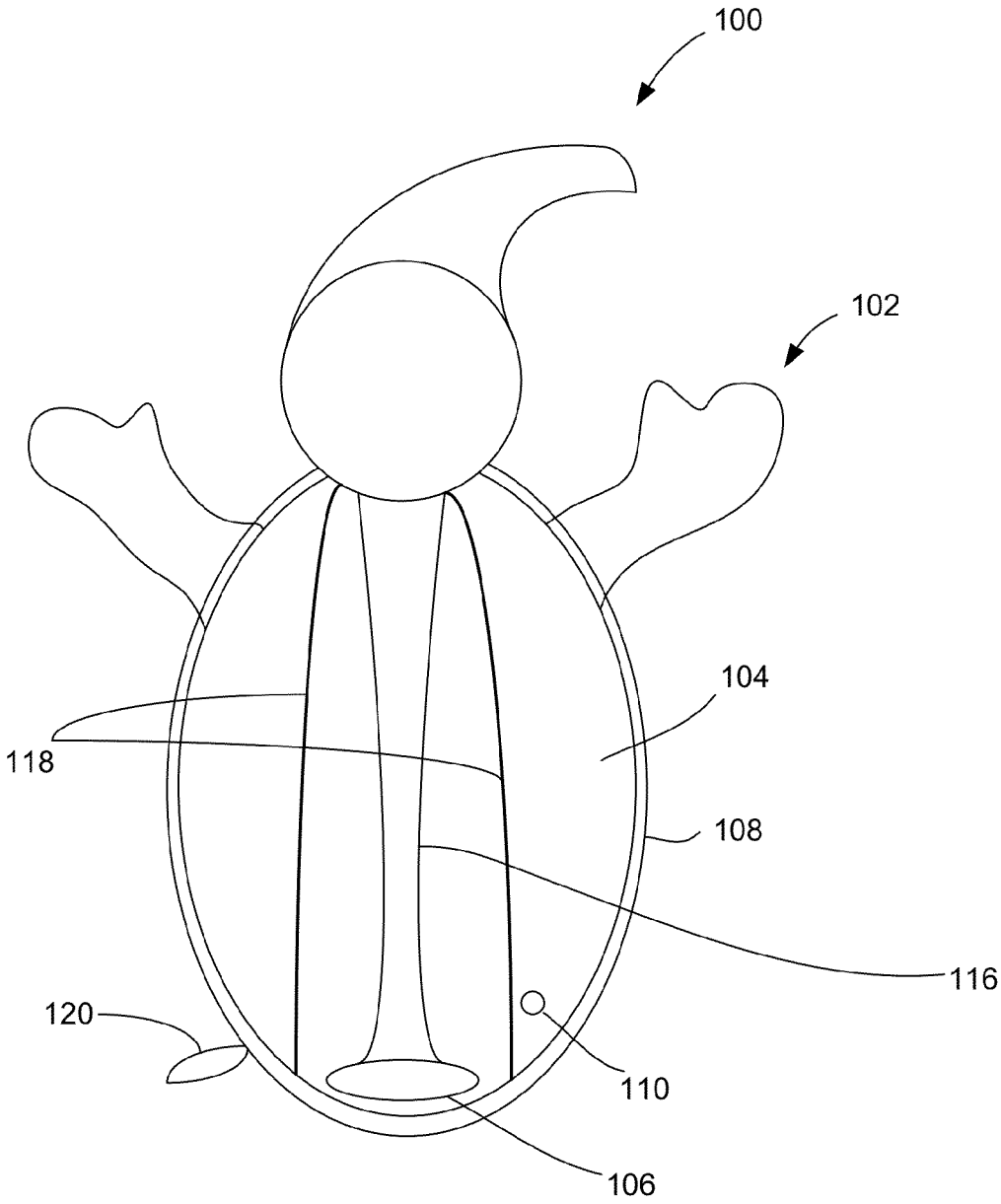
FIG. 1 is a front view of a decorative system, in accordance with an exemplary embodiment of the present invention.
Figure 2:
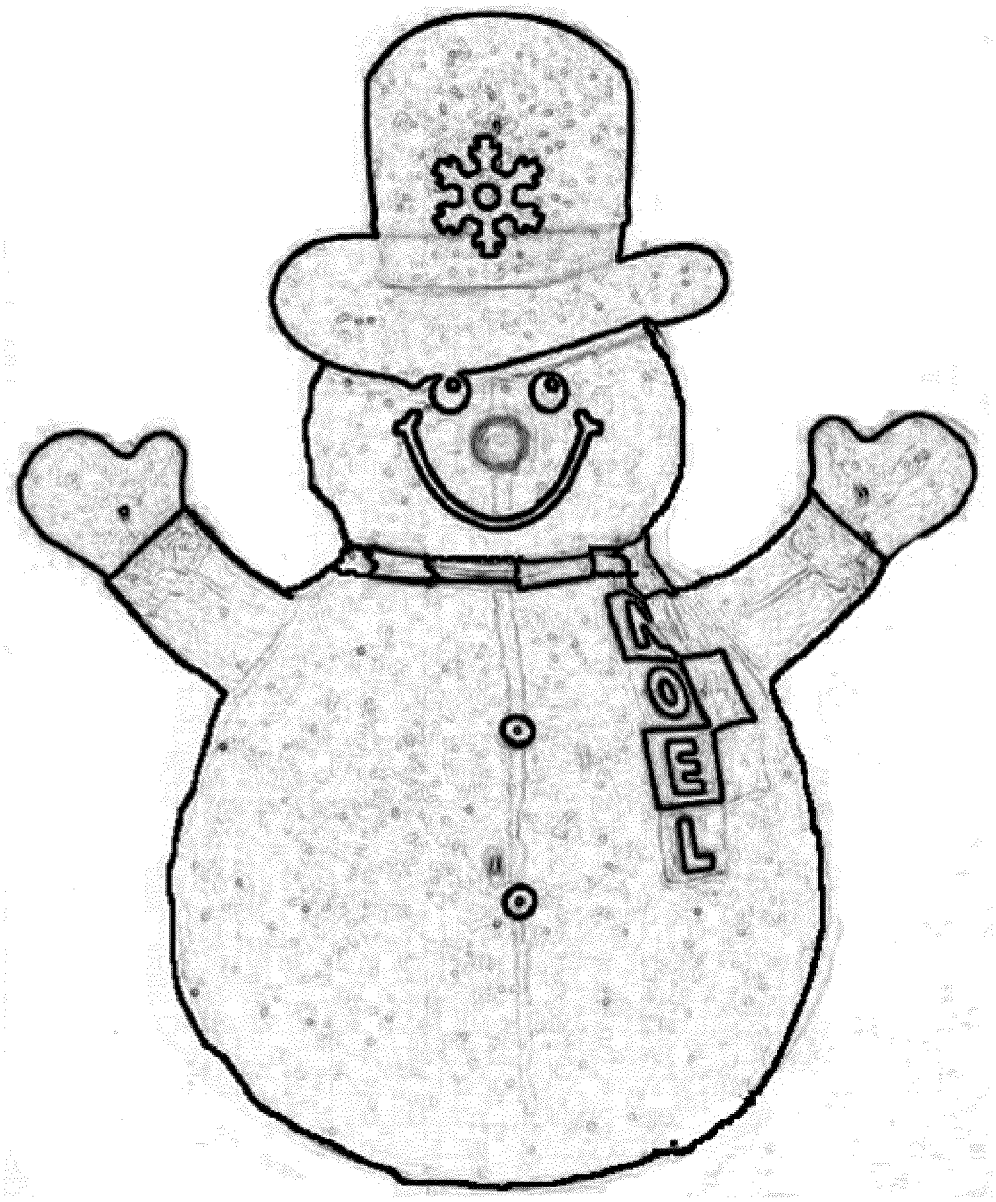
FIG. 2 is a front view of the decorative system covered by a covering, in accordance with an exemplary embodiment of the present invention.
Figure 3:
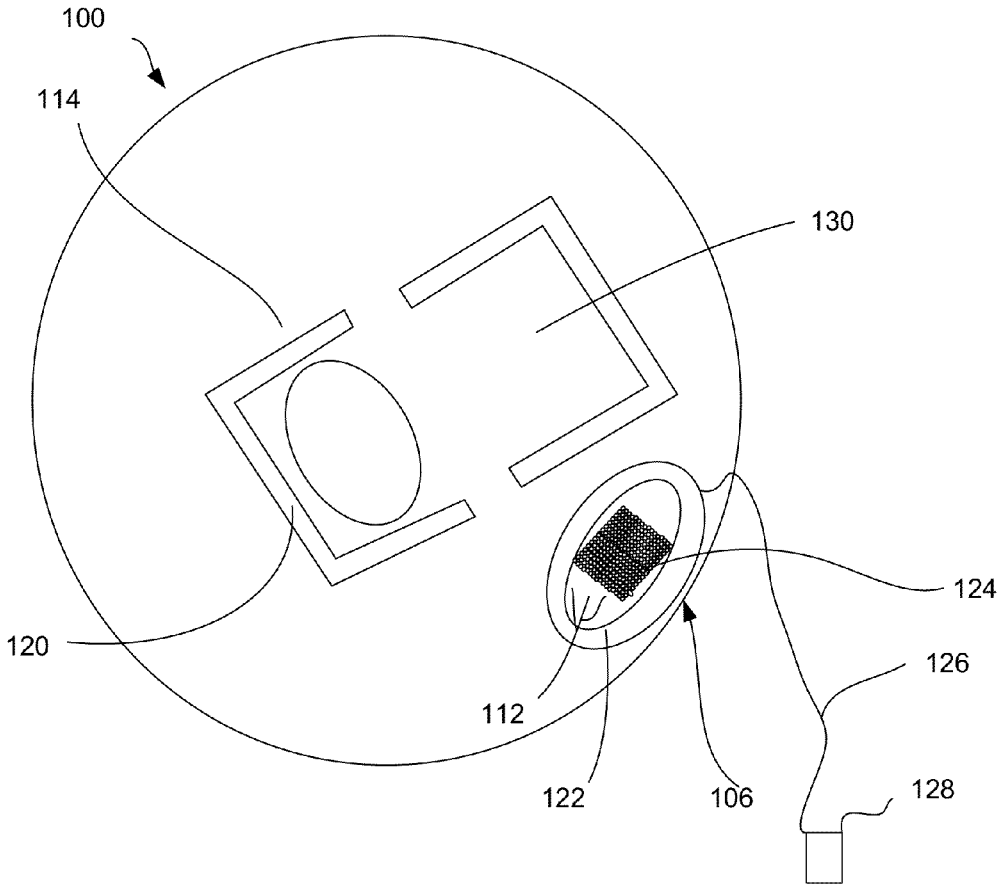
FIG. 3 is an illustration of the bottom of the decorative system, in accordance with an exemplary embodiment of the present invention.
Figure 4:
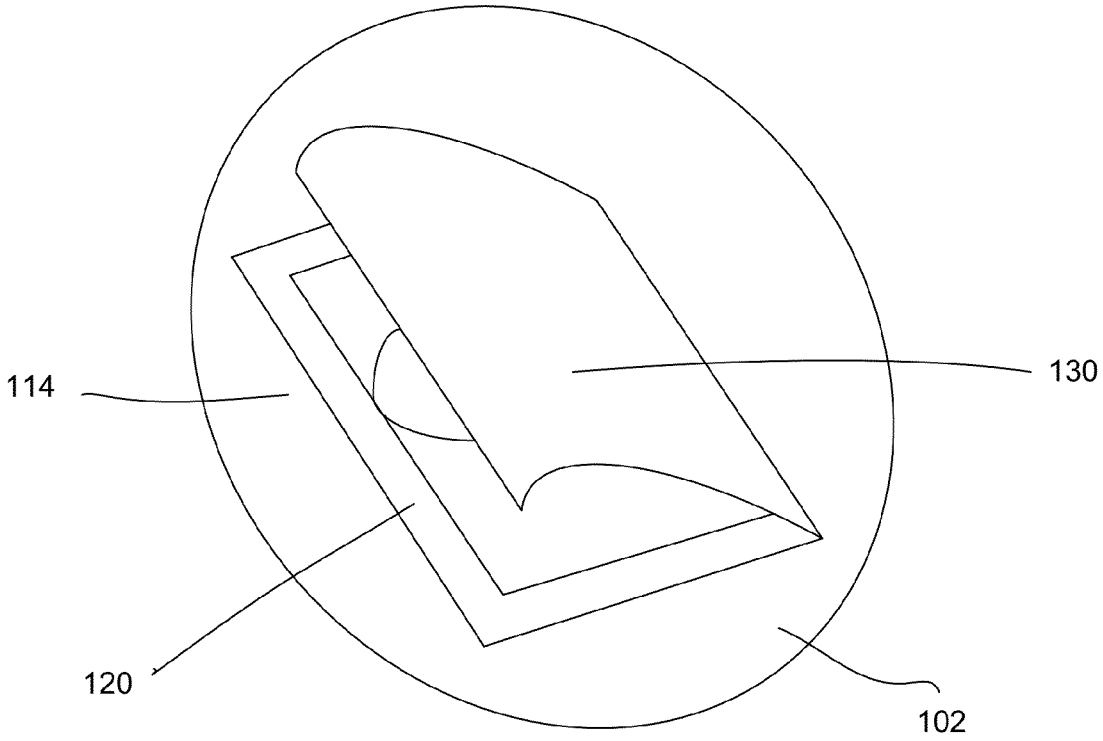
FIG. 4 is an illustration of the bottom of the decorative system showing a pouch for housing a light system, in accordance with an exemplary embodiment of the present invention.
Figure 5:
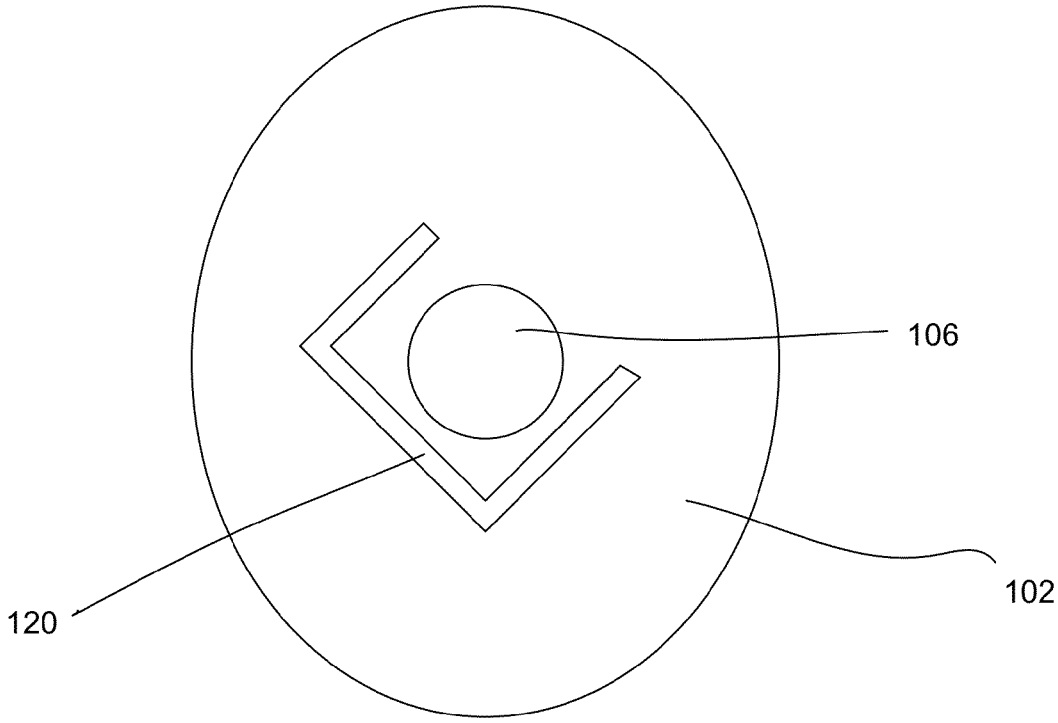
FIG. 5 is an illustration of the bottom of the decorative system housing the light system, in accordance with an exemplary embodiment of the present invention.

Any headings provided herein are for convenience only and do not necessarily affect the scope or meaning of the claimed presently disclosed subject matter.

DETAILED DESCRIPTION

The subject matter of the various embodiments is described with specificity to meet statutory requirements. However, the description itself is not intended to limit the scope of this patent. Rather, it has been contemplated that the claimed subject matter might also be embodied in other ways, to include different steps or elements similar to the ones described in this document, in conjunction with other present or future technologies. Moreover, although the term "step" may be used herein to connote different aspects of methods employed, the term should not be interpreted as implying any particular order among or between various steps herein disclosed unless and except when the order of individual steps is explicitly required. It should be understood that the explanations illustrating data or signal flows are only exemplary. The following description is illustrative and non-limiting to any one aspect.

It should also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named. Also, in describing preferred embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" one particular value and/or to "about" or "approximately" another particular value. When such a range is expressed, other exemplary embodiments include from the one particular value and/or to the other particular value. The terms "comprising" or "containing" or "including" mean that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

To facilitate an understanding of the principles and features of the presently disclosed subject matter, embodiments are explained hereinafter with reference to implementation in an illustrative embodiment. In particular, embodiments of the presently disclosed subject matter are described in the context of being a decorative inflatable system.

Embodiments of the presently disclosed subject matter, however, are not limited to use as a decorative inflatable system. Rather, embodiments of the presently disclosed subject matter can be used as a decorative bladder as needed or desired. For example, although embodiments of the presently disclosed subject matter are described as a bladder, it will be understood that the disclosed inflatable system can be used with many designs and can carry various materials needed to enhance the overall design.

The materials described hereinafter as making up the various elements of the presently disclosed subject matter are intended to be illustrative and not restrictive. Many suitable materials that would perform the same or a similar function as the materials described herein are intended to be embraced within the scope of the presently disclosed subject matter. Such other materials not described herein can include, but are not limited to, materials that are developed after the time of the development of the presently disclosed subject matter, for example.

Referring now to the figures, FIGS. 1-6 illustrate an exemplary decorative system 100 in accordance with an exemplary embodiment of the present invention. The decorative system 100 provides decoration, for example, because people enjoy decorating in the spirit of the holidays. As illustrated in FIGS. 1-6, a snowman can be an exemplary decorative system for a holiday, including for example Christmas. The following is a list, not to be exhaustive but only illustrative, of potential decorative system designs: gifts, candy cane(s), Santa Claus, polar bear(s), reindeer, Christmas tree(s), elves, manger(s), cross(es), ornament(s), sled(s), holly, bells, stockings, star, candles, sack of gifts, wreath(es), mistletoe, and the like, as well as combinations thereof.

Christmas, however, is not the only holiday for which the decorative system can be designed. The decorative system can entail designs for other holidays. For instance, the holiday of Halloween can include decorative systems, including, for example and not limitation, black cat(s), ghost(s), witch(es), bat(s), pumpkin(s), and the like, as well as combinations thereof. The holiday of Thanksgiving can include decorative systems, including, for example and not limitation, turkey, cornucopia, pilgrims, Indians, and the like, as well as combinations thereof. Still other events, such as Independence Day, birthdays, and Easter can provide decorative systems. Other examples can include flags, sports memorabilia, and other decorations capable of three-dimensional views. The decorative system can be manufactured for use both indoors and outdoors. The decorative system can include many types, shapes, and sized decorations.

Manufacturing the decorative system with flexible materials enables the system to conform to the desired shape of the design. In other words, because the decorative system is flexible and inflatable—it can be inflated, or deflated, as needed to conform to the desired design.

In an exemplary embodiment, the decorative system can be filled with air. This can enable it to be inflated and deflated relatively quickly using, for example and not limitation, a standard air mattress inflator/deflator. Easy portability of the decorative system is desirable. The decorative system can be inflated and, in some embodiments, frictionally held in place by a stake or by one or more tie-downs and/or stakes, for example, particularly if placed outside.

There are many benefits of the decorative system, including but not limited to reducing bulky packaging of decorative systems, reducing weight of decorative systems for ease of transport, reducing shipping weight and size of decorative systems, reducing cost of manufacturing of decorative systems, reducing shipping costs of decorative systems, ease of assembly, easy of disassembly, improvement in appearance, and the like.

Referring to FIGS. 1-6, the decorative system 100 includes an inflatable bladder assembly 102, a light system 106, and a covering 108. The inflatable bladder assembly 102 includes a bladder 104, which includes a seal 110 for dispensing and removing media to inflate and deflate the bladder 104. The interior of the bladder 104 is adapted to receive and hold media inserted or dispensed therein. When the bladder 104 is inflated, it provides a desired, decorative shape, for example and not limitation a decorative shape as mentioned previously. When the bladder 104 is not inflated, i.e., in a deflated state, it provides a foldable profile that has a low weight and is easy to package and/or ship. The light system 106 includes one or more light assemblies 112 (shown in FIG. 3) tied together with a plurality of conductive wires. The light system 106 can be secured to the exterior of the bladder 104 by an attachment assembly, for example, pocket or pouch 114 (shown in FIGS. 3-5). The covering 108 can cover the inflated bladder 104 to provide additional shape and structure to the decorative system 100.

The bladder 104 of the inflatable bladder assembly 102 can be made up of various polymers. In an exemplary embodiment, the bladder 104 is made of plastic. In some embodiments, the bladder 104 can be made of one or more interconnecting PVC (polyvinyl chloride) sheets.

The bladder 104 can be inflated when media is dispensed into the interior of the bladder 104. In some embodiments, the bladder 104 can be a sealed plastic container that includes a passage or seal 110. The passage 110 provides a conduit for media to enter the bladder 104 for inflation and to exit the bladder 104 for deflation. For example and not limitation, the bladder 104 can be inflated with a conventional air pressure device, such as a pump adapted to push air into the passage and thus fill the interior of the bladder for inflating (e.g., hand pump and/or an air mattress inflator/deflator). Media other than air can be used to fill the bladder 104. When inflated, the bladder 104 can make the shape of the decoration desired. In some cases, the media can be used to inflate the bladder 104 for a predetermined amount of time. For example, in cases in which helium is used as the media, it may be expected that the bladder 104 may only maintain the helium for a short time whereas if the media is water, the predetermined time may be longer.

The bladder 104 can include a diffusing mechanism 116 disposed therein. The diffusion mechanism 116, which in some embodiments can be have a cylindrical, tube-like shape, helps diffuse light being emitted from the light system 106 throughout the bladder 104. In some embodiments, the diffusing mechanism 116 can be a hollow elongate member extending from a bottom of the bladder 104, when the bladder 104 is filled with a medium and in its normal, operating position, to near the top of the bladder 104. In some examples, the diffusing mechanism 116 can be a plurality of diffusing mechanisms disposed in various parts of decorative system 100.

As the bladder 104 is inflated, the diffusing mechanism 116 can be assembled. For example, the diffusing mechanism 116 is coupled a first end to a bottom of the bladder 104 and at a second end in proximity to the top of the bladder 104. The diffusing mechanism 116 can be inflatable. The diffusing mechanism 116 can be a channel within the bladder 104 that can go from a folded position, when the bladder 104 is deflated, to an extended or use position, when the bladder 104 is inflated. In some embodiments, the diffusing mechanism 116 can be the same material as the bladder 104.

In some embodiments, the bladder 104 can be outfitted with one or more support rods 118 that can be placed along the perimeter of the bladder 104 for supporting it. The support rods 118 can further provide details to the overall design of the bladder 104. Easy portability of the decorative system 100 can be desirable. The decorative system 100 can be inflated and, in some embodiments, frictionally held in place by a stake or by one or more tie-downs and/or stakes (not shown), for example, particularly if placed outside. The tie-down or stakes can be inserted and secured to the decorative system 100 by a tab or stake holder (not shown).

In an exemplary embodiment, the pocket or pouch 114 can house the light system 106. The pocket or pouch 114 is positioned near the perimeter of the bladder 104. For example and not limitation, the pocket or pouch 114 can be positioned near or at the bottom of the bladder 104, which can hide the pocket or pouch 114 from plain sight, for example when the decorative system 100 is inflated and in use.

In some embodiments, the pocket or pouch 114 can be positioned at the terminus of the diffusing mechanism 116. Consequently, because the light system 106 is insertable into the pocket or pouch 114, the light being emitted from the light system 106 can travel within the diffusing mechanism 116 to diffuse light about the entire decorative system 100, i.e., about the entire bladder 104. In some embodiments, depending on the size and shape of the diffusing mechanism 116, the direction the light is illuminated within the bladder 104 can be controlled and tailored to enhance the brilliance of the decorative system 100.

In an exemplary embodiment, the pocket or pouch 114 can be coupled at a first side to the rear of the bladder 104. The remaining sides of the pocket or pouch 114 can be releasably attached to the bladder 104. For example and not limitation, the remaining sides of pocket or pouch 114, which can be configured as flap 130, can be releasably secured to the bladder 104 by a hook and loop system 120, such as Velcro®. Other easy to release systems can be used to open/close the pocket or pouch 114. When the pocket or pouch 114 is open, the light system 106 can be placed therein, and oppositely when the pocket or pouch 114 is closed the light system 106 cannot be placed there in. In some embodiments, it can be preferable for the pocket or pouch 114 to include a cutout or adapted to secure the light system 106 therein, while at the same time providing a means for an electric cord or wire to extend outwardly therefrom for powering the light system 106.

In an exemplary embodiment, the light system 106 includes a cradle 122, a circuit board 124, a plurality of light assemblies 112 carried by the circuit board 124, a conductive wire 126, and a plug 128. The cradle 122 can be a housing for the circuit board 124 and light assemblies 112. The light assemblies 112, as mentioned above, can be various light sources, including but not limited to a light bulb, light emitting diode (LED), incandescent lamp, halogen lamp, fluorescent lamp, and the like. Each light assembly 112 provides light when energized. Each light assembly 112 can be energized by inserting the plug 128 into a conventional outlet, e.g., a wall outlet. Energy then travels from the wall outlet into the plug 128 and through the connected conductive wire 126 to the circuit board 124. The circuit board 124 is configured such that the energy can be provided to each light assembly 112, which when it receives the energy causes the light assembly 112 to illuminate. The light system 106 can further include a cover, which can seal and protect the circuit board 124 and light assemblies 112 within the cradle 122.

To provide a more realistic decorative system 100, the inflatable bladder assembly 102 carrying the light system 106 can be covered by the covering 108. The covering 108 can be secured over the inflatable bladder assembly 102.

There are many methods of placing the covering 108 over the inflatable bladder assembly 102. In an exemplary embodiment, the bladder 104 can be manufactured and dressed with the covering 108. Then, when a user inflates the inflatable bladder assembly 102, the covering 108 automatically rises with the inflation of the bladder 104. In an exemplary embodiment, the inflatable bladder assembly 102 can be partially inflated, and then dressed with the covering 108. That is, the inflatable bladder assembly 102 can be partially inflated, such that the covering 108 fits over a significant portion of the bladder 104, then the covering 108 can be pulled up and over the inflatable bladder assembly 102, and ultimately the bladder 104 can be fully inflated. In another exemplary embodiment, the covering 108 can be placed over the inflatable bladder assembly 102 after the bladder 102 is fully inflated. Here, the covering 108 can be stretched and placed over the bladder 104.

In some embodiments, the covering 108 can be stitched over the bladder 104. For example, the bladder 104 can be inflated at the manufacturing facility, and then the covering 108 can be stitched thereupon. The covering 108 can further be partially adhered to the bladder. In some embodiments, the covering 108 has one or more openings to provide the ability to see the bladder 104. For example, in an exemplary embodiment, air pressure can be provided within the bladder 104 to provide the effect of snow within the bladder 104, like a snow globe concept, and the opening can provide a viewer to witness the snow globe effect within the bladder 104.

In some embodiments, the bladder 104 can include a pressure means and a plurality of objects. The pressure means can provide a media, such as air, to cause the objects to fly around within the bladder 104. For example, this can provide a snow globe effect.

Figure 6:
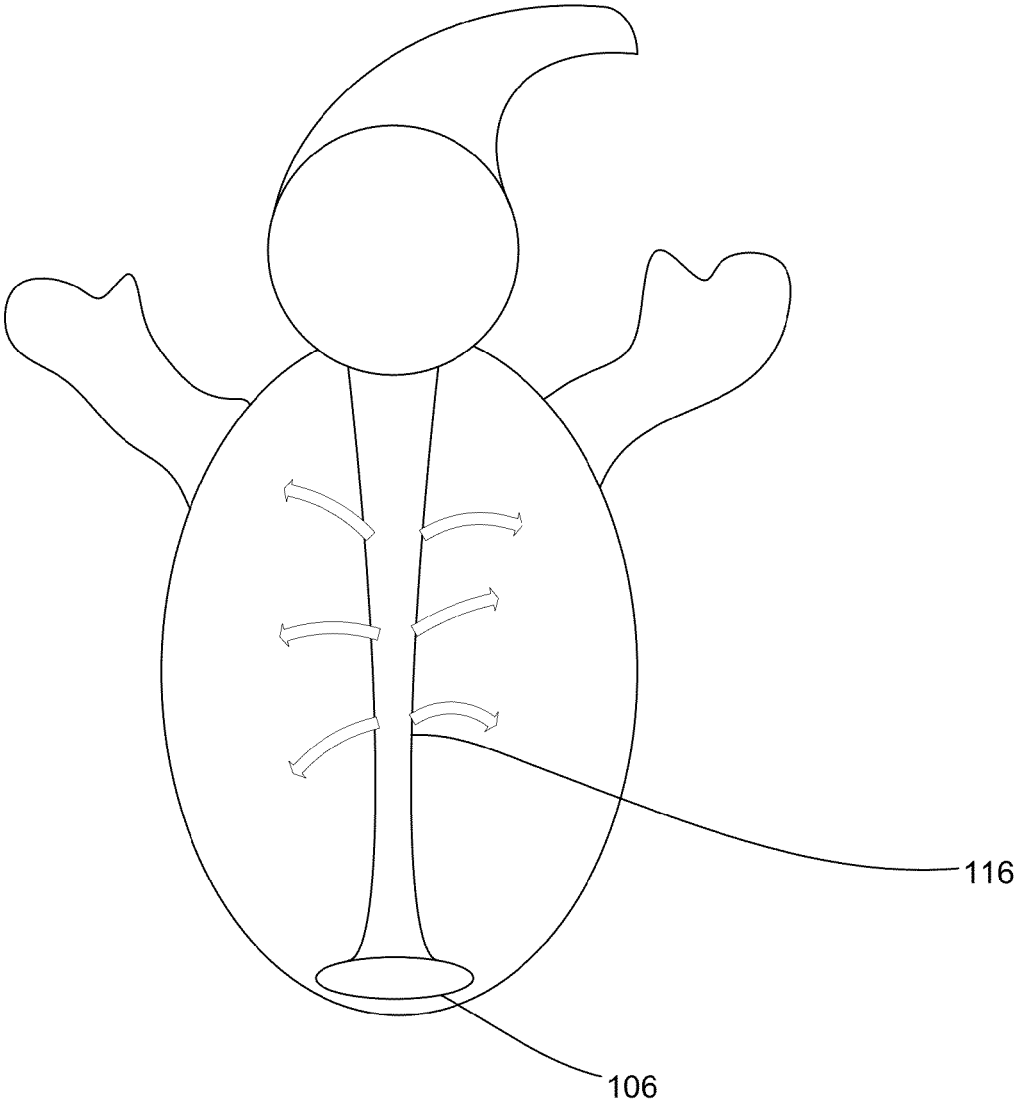
FIG. 6 is a front view of the decorative system, which carries the covering and is illuminated by the light system, in accordance with an exemplary embodiment of the present invention.

FIG. 6 further illustrates diffusing mechanism 116. When diffusing mechanism 116 of decorative system 100 receives light from light system 106, diffusing mechanism 116 is configured to diffuse the light in various ways. As shown by the arrows emanating from the center of diffusing mechanism 116, the light diffused out of diffusing mechanism in FIG. 6 emanates outward in various directions from diffusing mechanism 116. Diffusing mechanism 116 can be configured to diffuse light in various ways. For example, diffusing mechanism 116 can diffuse light only at certain locations or can diffuse only a portion of the light. Additionally, decorative system 100 can have more than one diffusing mechanism 116 providing various options for light distribution.

Figure 7:
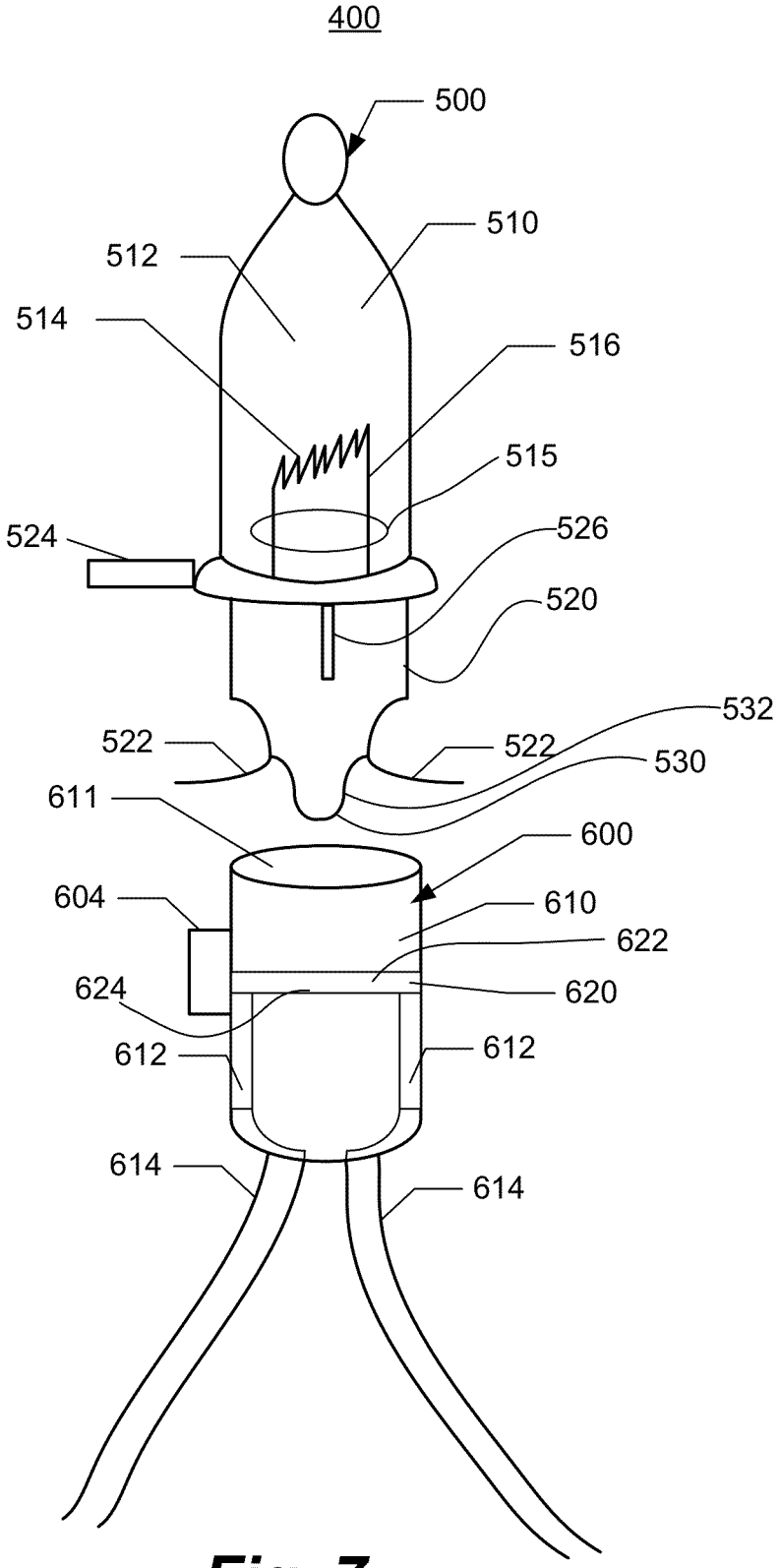
FIG. 7 is a cross-sectional illustration of a lamp system of a light string system, in accordance with an exemplary embodiment of the presently disclosed subject matter.

FIG. 7 illustrates a partial cross-sectional view of an exemplary and non-limiting embodiment of a lamp for use in a light system, such as light system 106 of FIGS. 1-6. In one example, a conventional light string system comprises a plurality of lamp systems 400 electrically connected in series, wherein each lamp system 400 includes the light assembly 500 and the socket assembly 600. The lamp system 400 can be a conventional lamp system or can be a shunted lamp system. A shunted lamp system is adapted to provide illumination to an electrical series light string system when a light assembly 500 is missing from the socket assembly 600, improperly seated from the socket assembly 600, or broken. In the shunted lamp system, a bypass activating system 530 can strike a bypass mechanism 620, when the light assembly is inserted into the socket assembly. On the other hand, when the light assembly is missing from the socket assembly 600, improperly seated from the socket assembly 600, or broken, the bypass mechanism can permit electrical energy or current to flow across the socket assembly 600 to the next lamp system in the light string system, which is generally described below.

In exemplary embodiments of the presently disclosed invention, the light assembly 500 can comprise a light source 510 and a base 520 in communication with the light source 510. In addition, the light assembly 500 can include the bypass activating system 530. The socket assembly 600 can comprise a socket 610 adapted to receive the light assembly 500. In addition, the socket assembly 600 can include the bypass mechanism 620 having a first position and a second position.

The light assembly 500 includes the light source 510, which provides light when energized. The light source 510 can be many types of light sources, including a light bulb, light emitting diode (LED), incandescent lamp, halogen lamp, fluorescent lamp, or the like. For example, the light source 510 can be a light bulb. The light assembly 500 and, more typically, the light bulb 510 of the light assembly 500 has a shunt device 515 to keep the light string system illuminated, even if the bulb 510 burns out or fails.

The light source 510 can include a globe 512 and a filament 514. The globe 512 is in communication with, and terminates at, the base 520. The globe 512 can be made of conventional translucent or transparent material such as plastic, glass, and the like. The globe 512 includes a hollow interior enabling protection of the filament 514.

When charged with energy, the filament 514 can illuminate the light source 510. A pair of conductors 516 can be in electrical communication with the filament 514. The conductors 516 enable energy into the light source 510 to illuminate the filament 514 and, as a result, the light source 510. The conductors 516 extend down through the base 520, wherein the conductors 516 can be integral with and/or in communication with a pair of lead wires 522 external the base 520. The lead wires 522 can be a pair of wires extending through a bottom of the base 520. A portion of the lead wires 522 that extends through the base can wrap around the base 520, for example, further extending upwardly in the direction of globe 512 adjacent the base 520.

The light assembly 500 further includes the base 520, which can be integrally formed with the light source 510 or a separate element from the light source 510. The base 520 communicates between the light source 510 and an associated socket 610, complimenting and facilitating the seating of the light assembly 500 into the socket 610. The base 520 can incorporate a least one ridge 526 to ensure a snug fit with the socket 610, preventing accidental disengagement of the light assembly 500 from the socket assembly 600 or ensuring proper seating of the light assembly 500 in the socket assembly 600. Other mechanical means can be used with the base 520 and the socket assembly 600 to ensure a tight fit.

For example, the light assembly 500 can also include a locking assembly to secure the light assembly 500 to the socket assembly 600. The locking assembly can be exterior or designed within the socket assembly 600 to fasten the connection of the light assembly 500 to the socket assembly 600 internally. The locking assembly can be external and can include cooperating light assembly elements 524 and socket assembly element 604. These elements 524 and 604 can be formed as a clasp and a lock to insert the clasp. For example, the base 520 of the light assembly 500 can include the element 524 that extends normal to the base 520 and can define an aperture. On the other end of the locking assembly can be the element 604 of the socket 610 to be inserted into the element 524 of the base 520. As the element 604 of the socket 610 is inserted into the element 524 of the base 520, the locking assembly locks the light assembly 500 to the socket assembly 600. Stringent Underwriters Laboratories (UL) requirements can require that lights and sockets fit tightly together, which can decrease the value of a locking mechanism in the lamp system 400. The improvement in injection molding machines now enables the production of sockets and lamp assemblies that have a tight, snug fit. In an exemplary embodiment, the locking assembly of the lamp system 400 can act as the extending member for locking the lamp system 400, and possibly the entire light string system, to the bladder 104.

In an exemplary embodiment, the bypass activating system 530 of the light assembly 500 can activate and deactivate the bypass mechanism 620 of the socket assembly 600 by moving the bypass mechanism 620 between the first and second positions. The bypass activating system 530 can extend in a downward direction from base 520 of the light assembly 500 to activate the bypass mechanism 620 of the socket assembly 600 upon the proper seating of the light assembly 500 in the socket assembly 600. The bypass activating system 530 can include one or more downwardly extending members. In one embodiment, the bypass activating system 530 can be in a downward "V" shape. Alternatively, the bypass activating system 530 can be one or more extending members 532, or can comprise various other configurations complementary to the configuration of the bypass mechanism 620.

The socket assembly 600 comprises the socket 610 adapted to receive the light assembly 500. The socket 610 defines a cooperatively-shaped aperture 611 to receive at least the base 520 of the light assembly 500. The socket 610 can also be adapted to receive the whole of the bypass activating system 530 of the light assembly 500. The socket 610 can be arranged in many shapes and sizes, but the socket 610 should be of a shape to conveniently receive the light assembly 500.

The socket 610 includes a pair of socket terminals 612. The socket terminals 612 can be located on opposing inner sides of the socket 610. The socket 610 further includes a pair of terminal wires 614 extending to the exterior to allow energy to enter and exit the socket 610. Each socket terminal 612 can be essentially an extension of each respective terminal wire 614. The terminal wire 614 extends through the bottom of the socket 610 to ultimately connect to an electrical source. Therefore, the electrical current is introduced into the socket 610 by one of the terminal wires 614 and conducted either through the bypass mechanism 620, if the bypass mechanism 620 is in the first position, or through lead wires 522 to the filament 514 to illuminate the light bulb 510, if in the second position. Regardless of path, the current can flow to the other of the lamp systems 100 of the light string.

The bypass mechanism 620 of the socket assembly 600 includes a conductive element 622, which rests in the socket 610. The conductive element 622 includes a first position and a second position corresponding to the first and second positions of the bypass mechanism 620. For example and not limitation, the bypass mechanism 620 incorporates the conductive element 622, such that an electric circuit extends from the left terminal wire 614, through the left socket terminal 612 across conductive element 622, and ultimately to the right terminal wire 614 via the right socket terminal 612.

In some embodiments, the conductive element 622 can be a spring 624 mechanism. The socket 610 is dimensioned to receive the insertion of the bypass activating system 530, which can force portions of the single spring 624 together, not apart, when the light assembly 500 is inserted into the socket 610. In other words, the bypass activating system 530 can cause the conductive element 622 to spring inwardly, toward the center of the socket 610. The single spring 624 springs apart, not together, when the light assembly 500 is removed from the light socket 610.

When the light assembly 500 is inserted into the socket 610, the bypass activating system 530 can push at least one side of the conductive element 622 down, distal the socket terminal 612 to "open" the circuit across 622. This disables the electrical connection that the bypass mechanism 620 created, and the circuit is closed via the bulb 510, as opposed to the conductive element 622. In an exemplary embodiment, both sides of the conductive element 622 can be disengaged by the bypass activating system 530. The bypass mechanism 620 can be maintained in the socket assembly by grooves/cutouts formed within the socket and/or a holder placed in the socket.

The bypass activating system 530 can have one or more pointed or rounded tips that facilitate disconnecting the bypass mechanism 620 from the socket terminals 612. The bypass activating system 530 disables the physical connection of the bypass mechanism 620, thereby eliminating any electrically conductive path for the electrical current to flow, other than through the inserted light assembly 500.

The bypass mechanism 620 permits the removal of one or more light assemblies 500 of the lamp system 400, while maintaining the lighting of the remaining lights of a light string system. When a light assembly 500 is missing from a socket 610, the bypass mechanism 620 creates a short circuit, and therefore enables current flow to continue to other lamp systems 400 within a light string. Each socket 610 can have a single current carrying bypass mechanism 620, which pushes away from the socket terminal 612 when the bypass activating system 530 engages the bypass mechanism 620, thereby breaking electrical continuity across the bypass mechanism 620. When the base 520 of the light assembly 500 is fully engaged in the socket 610, the lead wires 522 extending from the base 520 will make electrical contact with the socket terminals 612 completing the electrical circuit. When the light assembly 500 is removed, the bypass mechanism 620 again makes contact with the socket terminals 612, maintaining the electrical connection.

The bypass mechanism 620 has at least two positions—a first position and a second position. The first position bypasses energy flow when a light assembly 500 is burnt, missing, or not properly seated in the socket 610. In the first position, the bypass mechanism 620 extends to make contact with the sides of the socket 610, the socket terminals 612. As a result, an electrical circuit is created, or a short circuit is formed. This situation arises when the light assembly 500 is missing from or improperly seated in the socket 610. The second position enables energy to flow through the light source 510 to illuminate it. In the second position, the bypass mechanism 620 is removed from electrical communication from at least one side of the socket 610 (at least one of the socket terminals 612). The electrical circuit through the bypass mechanism 620 is disconnected, or an open circuit is formed. This situation typically arises when a light assembly 500 is fully inserted, and thus properly seated, in the socket 510. For instance, the bypass activating system 530 pushes the bypass mechanism 620 together when the light assembly 500 is being seated in the socket 610; and the bypass mechanism 620 pushes apart when the light source 510 is being removed from the socket 610.

Finally, while the present disclosure has been described in connection with a plurality of exemplary aspects, as illustrated in the various figures and discussed above, it is understood that other similar aspects can be used or modifications and additions can be made to the described aspects for performing the same function of the present disclosure without deviating therefrom. For example, in various aspects of the disclosure, methods and compositions were described according to aspects of the presently disclosed subject matter. However, other equivalent methods or composition to these described aspects are also contemplated by the teachings herein. Therefore, the present disclosure should not be limited to any single aspect, but rather construed in breadth and scope in accordance with the appended claims.

What is claimed is:

1. An inflatable decorative system, comprising:

an inflatable bladder assembly comprising an inflatable bladder having a first aperture for introducing media into the inflatable bladder;

a light system comprising:

a light assembly comprising:

a light source;

a base; and a bypass activating system extending downwardly from the base;

a socket assembly dimensioned to receive via insertion at least a portion of the base of the light assembly;

a bypass mechanism positioned within the socket assembly comprising a conductive element having a pair of arms, wherein one or both of the arms of the conductive element are moveable between a first and second position;

wherein the bypass activating system causes one or both of the arms to move to a first position to cause current flow through the light assembly upon insertion of the bypass activating system into the socket assembly; and wherein upon removal of the bypass activating system from the socket assembly the current flow is bypassed around the light assembly and through the socket assembly;

a second aperture disposed on the inflatable bladder assembly configured to receive at least a portion of the light system; and a covering to a least partially cover the inflatable bladder assembly.

2. An inflatable decorative system, comprising:

an inflatable bladder assembly comprising an inflatable bladder having a first aperture for dispensing gaseous media into the bladder to inflate the bladder;

a light system comprising:

a light assembly comprising:

a light source;

a base; and a bypass activating system extending downwardly from the base;

a socket assembly dimensioned to receive via insertion at least a portion of the base of the light assembly;

a bypass mechanism positioned within the socket assembly comprising a conductive element having a pair of arms, wherein one or both of the arms of the conductive element are moveable between a first and second position;

wherein the bypass activating system causes one or both of the arms to move to a first position to cause current flow through the light assembly upon insertion of the bypass activating system into the socket assembly;

wherein upon removal of the bypass activating system from the socket assembly the current flow is bypassed around the light assembly and through the socket assembly;

a second aperture disposed on the bladder assembly configured to receive at least a portion of the light system; and a covering.

3. The inflatable decorative system of claim 2, further comprising a flap configured to at least partially seal the second aperture.

4. The inflatable decorative system of claim 2, further comprising at least one diffusing member for diffusing at least a portion of the light emanated from the light system.

5. An inflatable decoration having a shape associated with a particular festive occasion, comprising:

an inflatable bladder assembly comprising an inflatable bladder having a first aperture for introducing media into the inflatable bladder;

a light system comprising:

a light assembly comprising:

a light source;

a base; and a bypass activating system extending downwardly from the base;

a socket assembly dimensioned to receive via insertion at least a portion of the base of the light assembly;

a bypass mechanism positioned within the socket assembly comprising a conductive element having a pair of arms, wherein one or both of the arms of the conductive element are moveable between a first and second position;

wherein the bypass activating system causes one or both of the arms to move to a first position to cause current flow through the light assembly upon insertion of the bypass activating system into the socket assembly; and wherein upon removal of the bypass activating system from the socket assembly the current flow is bypassed around the light assembly and through the socket assembly;

a second aperture disposed on the inflatable bladder assembly configured to receive at least a portion of the light system;

at least one diffusing member for diffusing light emanated from at least one light of the light system; and a covering to a least partially cover the inflatable bladder assembly.

6. The decoration of claim 5, wherein the bypass activating system comprises at least one downwardly extending member.

7. The decoration of claim 5, wherein the bypass mechanism comprises a holder and conductive element, wherein the holder comprises a cutout along its width adapted to receive and carry the conductive element therein, and wherein the conductive element comprises a pair of arms extending the length of the diameter of the socket.

8. The decoration of claim 7, wherein the conductive element is a spring.

* * * * *